United States Patent [19]

Ballentine et al.

[11] Patent Number: 5,028,747

[45] Date of Patent: Jul. 2, 1991

[54] DISTRIBUTOR CAP

[75] Inventors: Richard E. Ballentine; Ray J. Daniels; Thomas E. Welsh, Jr., all of Anderson; Richard L. Haisley, Muncie, all of Ind.

[73] Assignee: General Motors Corporation, Detroit, Mich.

[21] Appl. No.: 588,631

[22] Filed: Sep. 26, 1990

[51] Int. Cl.[5] ..... H01H 19/00

[52] U.S. Cl. ..... 200/19 DC; 200/19 R

[58] Field of Search ..... 200/19 RC, 19 R

[56] References Cited

U.S. PATENT DOCUMENTS

| | | | |
|---|---|---|---|
| 2,169,595 | 8/1939 | Sherman | 200/19 R |
| 2,174,081 | 9/1939 | Fitzsimmons | 200/19 R |
| 2,246,901 | 6/1941 | Schwarzmann | 200/19 R |
| 3,435,161 | 3/1969 | Webster . | |
| 3,504,141 | 3/1970 | Webster . | |
| 3,646,922 | 3/1972 | Spalding . | |
| 3,951,736 | 7/1977 | Morgan et al. | 200/19 R |
| 4,045,636 | 8/1977 | Yoder et al. . | |
| 4,182,940 | 1/1980 | Scussel et al. | 200/19 R |
| 4,217,470 | 8/1980 | Kirner | 200/19 R |
| 4,365,366 | 10/1982 | Harper . | |
| 4,897,514 | 1/1990 | Arima et al. | 200/19 DC |

*Primary Examiner*—Harold Broome

*Attorney, Agent, or Firm*—Creighton R. Meland

[57] ABSTRACT

A distributor cap for an internal combustion engine ignition distributor. The distributor cap is comprised of a cap member formed of insulating material that has terminals located at the outer periphery of the cap member that are adapted to be connected to ignition cables. The cap member has a laterally extending wall. A plurality of electrodes are carried by the wall and extend through the wall. End portions of the electrodes are located inside the wall and are adapted to cooperate with a distributor rotor. A respective terminal is electrically connected to a respective electrode by a conductive ink trace that is bonded to an outer surface of the wall.

10 Claims, 2 Drawing Sheets

DISTRIBUTOR CAP

Figure 1:
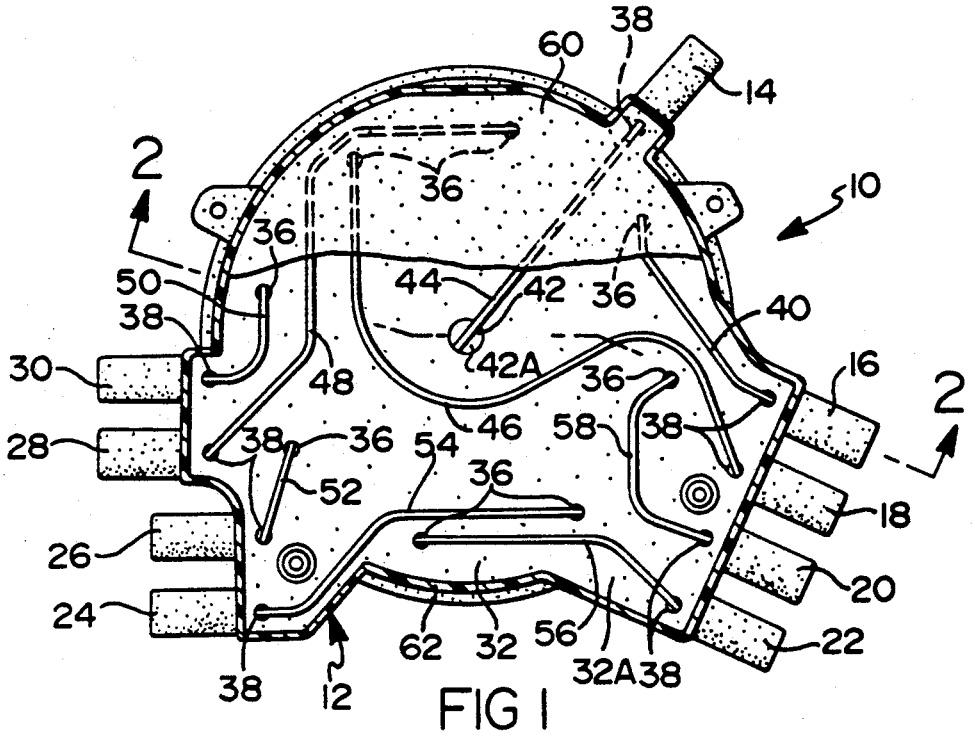

This invention relates to a distributor cap for internal combustion engine ignition distributors.

Distributor caps for ignition distributors that have terminals that extend radially of the cap are known, examples being the distributor caps shown in the United States patents to Morgan et al. U.S. Pat. No. 3,591,736 and to Arima et al. U.S. Pat. No. 4,897,514.

The distributor cap of this invention, like the above-referenced patents, has terminals that have portions that extend radially of the cap. However, unlike the distributor cap of the above-referenced patents, the distributor cap of this invention utilizes conductive ink traces to electrically connect terminals, that are adapted to be connected to ignition cables, with the inserts or electrodes of the distributor cap that cooperate with a distributor rotor.

It, accordingly, is one of the objects of this invention to provide an ignition distributor cap that utilizes conductive ink traces to electrically connect terminals, that are adapted to be connected with ignition cables, with the inserts or electrodes of the cap that cooperate with the distributor rotor.

Another object of this invention is to provide a distributor cap that has a laterally extending wall and wherein the ink traces are bonded to an outer surface of the wall. The inserts or electrodes are carried by the wall and extend through the wall. The terminals are carried by the cap and have end surfaces located adjacent the outer surface of the wall. Portions of the ink traces are bonded to the end surfaces of the terminals and to end surfaces of the inserts or electrodes. The ink traces may be covered by a potting compound or by a cover formed of insulating material.

IN THE DRAWINGS

Figure 2:
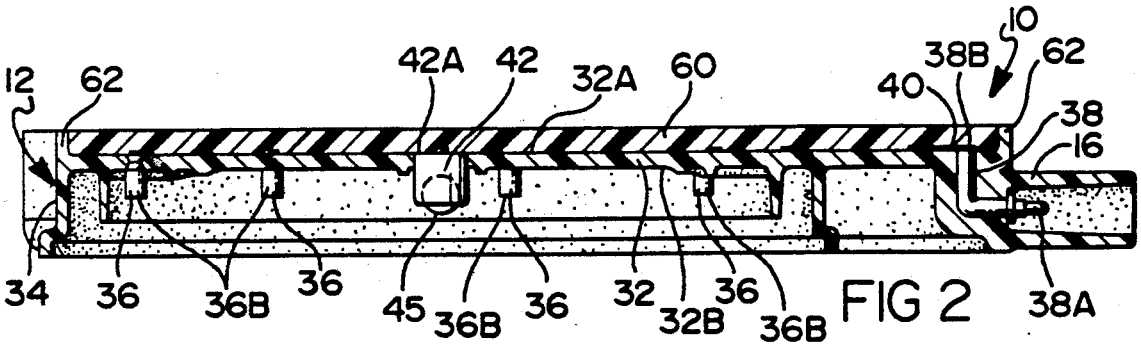
Figure 4:
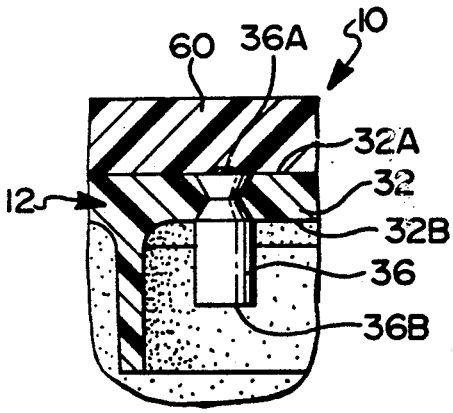
Figure 3:
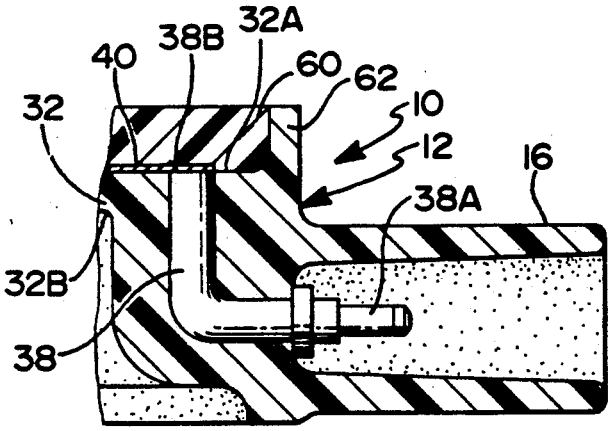
Figure 5:
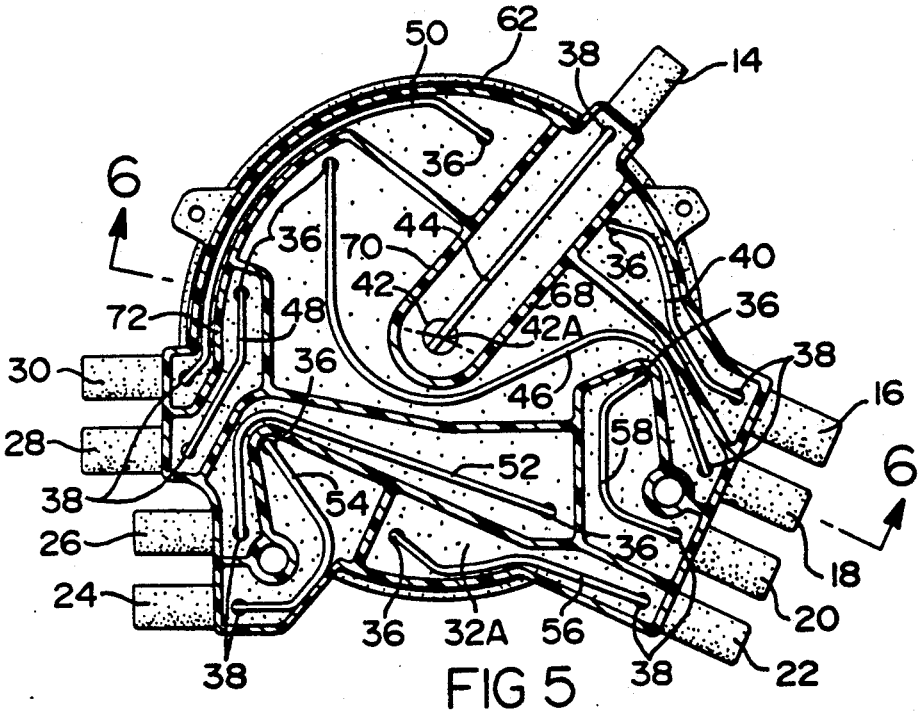
Figure 6:
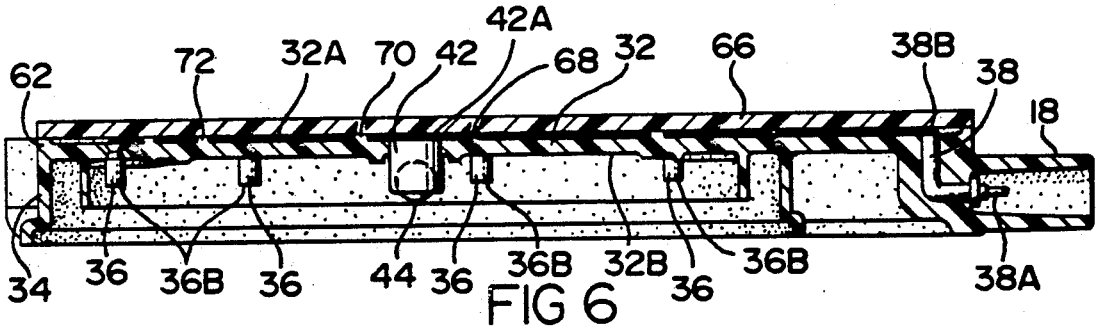

FIG. 1 is a plan view with parts broken away of a distributor cap made in accordance with this invention, FIG. 2 is an enlarged sectional view taken along line 2—2 of FIG. 1, FIG. 3 is an enlarged view of a portion of FIG. 2, FIG. 4 is an enlarged view of another portion of FIG. 2, FIG. 5, is a plan view of a modified distributor cap made in accordance with this invention, FIG. 6 is a sectional view taken along line 6—6 of FIG. 5.

Referring now to the drawings, and more particularly to FIGS. 1 and 2, the distributor cap 10 of this invention has a cap member 12. Cap member 12 is a molded plastic part and it has nine tubular housing parts 14–30. Cap member 12 can be formed of a 30–35% glass filled moldable thermoplastic polyester material such as a material sold under the trade name "RYNITE 935" by E. I. DuPont de Nemours & Co. The cap member 12 further has a laterally extending wall 32 that has opposed flat surfaces 32A and 32B. The cap member 12 also has an axially extending outer peripheral wall 34. Tubular portions 14–30 extend radially, and as will be more fully described hereinafter, are adapted to accommodate ignition cables.

The wall 32 carries a plurality of metallic electrodes or inserts each designated as 36. The electrodes 36 may be formed of aluminum. Since the distributor cap is for an eight cylinder engine, there are eight electrodes 36 located on an imaginary circle, as shown in FIG. 1.

These electrodes are all molded into wall 32 and extend through wall 32. The electrodes 36 have a circular cross section and have opposed flat end surfaces 36A and 36B. End surface 36A is substantially flush with surface 32A of wall 32. End surfaces 36B are located inside of cap member 12. The conductive insert of a distributor rotor (not illustrated) swings past end surfaces 36B when the distributor cap is in use on a distributor.

The cap member 12 further carries nine L-shaped metallic terminals each designated as 38 which are molded into the plastic material of cap member 12. Terminals 38 may be formed of zinc. Only one terminal 38 has been illustrated, since the other eight terminals are the same as the one illustrated. The terminal 38 that has been illustrated is shown associated with tubular housing portion 16. Thus, as shown in FIGS. 2 and 3, the terminal 38 has a male terminal portion 38A that projects into tubular housing portion 16. Terminal 38 further has a surface 38B that is bonded to and therefore electrically connected to a conductive ink trace 40 in a manner that will be more fully described hereinafer. Surface 38B of terminal 38 is substantially flush with surface 32A of wall 32. Tubular housing portion 14 and portions 18–30 each have an L-shaped connector 38.

Wall 32 of cap member 12 carries a center contact assembly comprised of metallic insert 42 and a spherical carbon ball 45 that is carried by insert 42. Insert 42 can be formed of aluminum and it has a flat surface 42A that is substantially flush with surface 32A of wall 32. The ball 45 is adapted to engage the conductive metallic spring portion of a distributor rotor. The flat surface 42A is connected to a conductive ink trace as is described more fully hereinafter.

The various terminals and electrodes that have been described are electrically connected by conductive ink traces in a manner that will now be described. As an example of the ink trace connections, it can be seen that ink trace 40 electrically connects a terminal 38 associated with tubular housing portion 16 to an electrode or insert 36. The ink trace 40 is bonded to surface 32A of wall 32 and the ends of ink trace 40 are bonded respectively to surface 38B of terminal 38 and surface 36A of an electrode or insert 36 to thereby electrically connect the ends of trace 40 to terminal 38 and an insert 36. As previously pointed out, surfaces 38B and 36A are substantially flush with surface 32A of wall 32.

Ink trace 44 electrically connects the terminal 38 associated with housing portion 14 to insert 42. Ink traces 46-58 respectively connect a terminal 38 to an insert 36. The ink traces 44-58 are all bonded to surface 32A and they all are bonded to ends of the respective terminals 38 and electrode 36 in the same manner that has been described in regard to the connection of ink trace 40 to surfaces 38B and 36A. It is noted that surface 42A of center insert 42 is substantially flush with surface 32A and surface 42A is bonded to an end portion of trace 44.

In the manufacture of the distributor cap that has been described, the electrodes 36 and terminals 38 and insert 42 are molded to the plastic material of the cap member 12. The ink traces are then applied to surface 32A and over the end surfaces of electrodes 36 and terminals 38 and over the end surface of insert 42 to make electrical connections to these parts.

After the ink traces have been applied, a plastic potting compound 60, formed of electrical insulating material is applied over the conductive traces. The potting compound 60 completely fills the cavity defined by marginal wall 62 and surface 32A. The potting compound engages and is bonded to surface 32A and engages and covers the ink traces. The potting compound 60 serves to electrically insulate the traces from each other and forms an end wall for the cap. Potting compound 60 further operates as a high voltage insulator and as a hermetic seal to prevent moisture intrusion into the high voltage conducting parts. The potting compound 60 can be comprised of an epoxy resin and a curing agent with an inert filler.

The cap that has been described is adapted to be secured to a distributor. The distributor shaft drives a rotor (not illustrated) which has a spring contact that engages ball 45. The conductive insert of the rotor swings past the ends 36B of the inserts 36.

In use, the terminals 38 associated with tubular housing portions 16–30 are connected respectively to spark plugs on the engine. The terminal 38 associated with tubular housing portion 14 is connected to the secondary winding of an ignition coil.

FIGS. 5 and 6 illustrate a modified distributor cap made in accordance with this invention. The same reference numerals have been used in FIGS. 5 and 6 as were used in FIGS. 1–4 to identify corresponding parts.

The pattern of the conductive ink traces in FIGS. 5 and 6 is somewhat different than the pattern of ink traces shown in FIG. 1. The primary difference, however, between the cap of FIGS. 5 and 6 and the cap of FIGS. 1–4 is that in the cap of FIGS. 5 and 6 a lid or cover 66 that is formed of a molded plastic insulating material is used instead of the potting compound 60. Further in the cap of FIGS. 5 and 6, the conductive ink traces are insulated from each other by divider ribs that extend axially from surface 32A. Some of the divider ribs have been designated by reference numerals, namely ribs 68, 70 and 72. It can be seen that the pattern of ribs together with wall 62 serve to insulate each conductive trace from an adjacent conductive trace.

The upper surfaces of the ribs and the upper surface of wall 62 are welded to plastic lid or cover 66. The lid or cover 62 prevents the high voltage on the traces from arcing to ground and also provides a hermetic seal to prevent moisture intrusion into the high voltage conducting parts.

The conductive ink that is used for the traces can take various forms as long as it can be applied in a liquid form and which after being applied cures to a solid form that is bonded to surface 32A and to connector surfaces of the various terminals and inserts. The conductive ink can take the form of an ink composition containing a finely divided metal powder such as particles of silver, a curable polymer and a solvent or thinner. One material that may be utilized is a thick film material type 4922N available from the Electronics Department of E. I. DuPont de Nemours & Co. This material is about 60% by weight silver metallic particles and uses an acrylic resin as a binder. After this material is applied to form the traces, the material can be cured at a temperature of about 200° F. The metallic particles are carried by the resin binder and the binder is bonded to the surface 32A.

As has been described, the ink traces are applied directly to flat surface 32A in a predetermined pattern. This is accomplished by use of a suitable applicator like a hypodermic needle which can be moved by a robot to apply a predetermined trace pattern to flat surface 32A. The ink traces may be about 1 mm. wide.

The embodiments of the invention in which an exclusive property or privilege is claimed are defined as follows:

1. A distributor cap for an internal combustion engine ignition distributor comprising, a cap member formed of electrical insulating material having a laterally extending wall, a plurality of electrodes carried by and extending through said wall, portions of said electrodes extending away from said wall and into an interior of said cap member to provide electrode means that is adapted to cooperate with a distributor rotor, a plurality of terminals carried by said cap member that are connectable to external circuits, said terminals being located at the outer periphery of said cap member and each terminal having a substantially radially extending electrical connector means, a plurality of electrical conductors comprised of an electrically conductive composition bonded to outer surface portions of said wall, each electrical conductor having opposed end portions that are respectively bonded to a said electrode and to a said terminal, and an end cap formed of electrical insulating material secured to said cap member and covering said electrical conductors.

2. The distributor cap according to claim 1 where said end cap is formed of an electrical insulating potting compound that engages said electrical conductors and outer surface portions of said wall.

3. The distributor cap according to claim 1 where said end cap is a molded plastic part that is secured to said cap member.

4. The distributor cap according to claim 1 where said electrical conductors are conductive ink traces.

5. The distributor cap according to claim 1 where said cap member has ribs that extend axially of an outer surface of said wall, said ribs being disposed on opposite sides of a respective electrical conductor and wherein said end cap is comprised of a molded plastic part that is secured to said cap member.

6. The distributor cap according to claim 1 where said terminals are L-shaped and where portions of said terminals extend radially of said cap member.

7. A distributor cap for an internal combustion engine ignition distributor comprising, a cap member formed of electrical insulating material having a laterally extending wall, a plurality of electrodes carried by and extending through said wall, each said electrode having a connector surface that is located substantially flush with outer surface portions of said wall, each said electrode having a portion disposed at an interior of said cap member that are adapted to cooperate with a distributor rotor, a plurality of terminals carried by said cap member located at the outer periphery of said cap member, each said terminal having a connector surface located substantially flush with outer surface portions of said wall, a plurality of electrical conductors comprised of an electrically conductive composition bonded to outer surface portions of said wall, each said electrical conductor having opposed end portions that are respectively bonded to a connector surface of an electrode and to a connector surface of a terminal, and electrical insulating means covering said electrical conductors.

8. The distributor cap according to claim 7 where said insulating means is an electrical insulating potting compound that engages said electrical conductors and outer surface portions of said wall.

9. The distributor cap according to claim 7 where said terminals are L-shaped and where portions of said terminals extend radially of said cap member.

10. A distributor cap for an internal combustion engine ignition distributor comprising, a cap member formed of electrical insulating material having a laterally extending wall, said wall having a first surface facing an interior of the cap member and a second opposed flat surface, a plurality of electrodes carried by and extending through said wall, portions of said electrodes extending away from said first surface and into the interior of said cap member to provide electrode means that is adapted to cooperate with a distributor rotor, a plurality of terminals carried by said cap member that are connectable to external circuits, said terminals located at the outer periphery of said cap member, a plurality of electrical conductors comprised of an electrically conductive composition bonded to said second flat surface of said cap member, each electrical conductor having opposed end portions that are respectively bonded to a said electrode and to a said terminal, and an end cap formed of electrical insulating material secured to said cap member and covering said electrical conductors.

* * * * *